US007878732B2

(12) United States Patent
Sandoval

(10) Patent No.: US 7,878,732 B2
(45) Date of Patent: Feb. 1, 2011

(54) SYSTEMS AND METHODS FOR PROVIDING A WATERCRAFT DOCKING DEVICE

(76) Inventor: Richard Sandoval, 426 W. Birchcreek Rd., Ririe, ID (US) 83443

( * ) Notice: Subject to any disclaimer, the term of this patent is extended or adjusted under 35 U.S.C. 154(b) by 202 days.

(21) Appl. No.: 12/101,815

(22) Filed: Apr. 11, 2008

(65) Prior Publication Data

US 2009/0020058 A1 Jan. 22, 2009

Related U.S. Application Data

(60) Provisional application No. 60/911,778, filed on Apr. 13, 2007, provisional application No. 60/942,154, filed on Jun. 5, 2007.

(51) Int. Cl.
*B63C 3/02* (2006.01)

(52) U.S. Cl. ..... 405/1

(58) Field of Classification Search ..... 405/1
See application file for complete search history.

(56) References Cited

U.S. PATENT DOCUMENTS 3,579,996 A * 5/1971 Edson ..... 405/1
5,067,428 A * 11/1991 Dickerson et al. ..... 405/1
5,460,112 A 10/1995 Travioli
5,961,139 A 10/1999 Nichols, II
6,263,820 B1 * 7/2001 Crifase et al. ..... 114/219
6,637,975 B2 * 10/2003 Foxwell ..... 405/2
6,644,231 B2 11/2003 Crifase et al.
6,964,241 B1 11/2005 Krebs

FOREIGN PATENT DOCUMENTS

JP 11348646 12/1999

* cited by examiner

*Primary Examiner*—Stephen Avila
(74) *Attorney, Agent, or Firm*—David B. Tingey; Kirton & McConkie

(57) ABSTRACT

Systems and methods for providing a docking device for watercrafts. An apparatus that is configured to receive a watercraft and includes a fold down anchor on one end of a frame for the purpose of anchoring the apparatus onto the shore, using the weight of the watercraft. Extendable arms on each side of the frame, opposite the anchor, fold out to stabilize the apparatus on the shore. The apparatus further includes a receiving system that includes one or more rollers. Where four rollers are used, a first set of two rollers sit above the anchor to guide the watercraft onto the apparatus while gliding onto the shore. A second set of two rollers are located on the top of the mounting device to hold the hull in place while docked.

20 Claims, 12 Drawing Sheets

SYSTEMS AND METHODS FOR PROVIDING A WATERCRAFT DOCKING DEVICE

RELATED APPLICATIONS

This application claims priority to U.S. Provisional Patent Application Ser. No. 60/911,778 filed Apr. 13, 2007, entitled SYSTEMS AND METHODS FOR PROVIDING A WATERCRAFT DOCKING DEVICE, and to U.S. Provisional Patent Application Ser. No. 60/942,154 filed Jun. 5, 2007, entitled SYSTEMS AND METHODS FOR PROVIDING A WATERCRAFT DOCKING DEVICE, both of which are incorporated herein by reference.

BACKGROUND OF THE INVENTION

1. Field of the Invention

The present invention relates to watercrafts. In particular, the present invention relates to systems and methods for providing a docking device for watercrafts.

2. Background and Related Art

Currently, a boater that has launched his/her boat onto the water, such as a lake, and wants to dock the boat for a period of time can spend a considerable amount of time and fuel looking for an available dock. This is particularly the case on a day when many boats are on the lake. Sometimes the search for an available dock is without success. Alternatively, boaters currently run their boat upon the shore in order to beach the boat. When this technique is chosen, the boater runs the risk of causing damage to hull of the boat, especially upon a rocky shore.

Thus, while techniques currently exist that are used to dock or beach a boat, challenges still exist. Accordingly, it would be an improvement in the art to augment or even replace current techniques with other techniques.

SUMMARY OF THE INVENTION

The present invention relates to watercrafts. In particular, the present invention relates to systems and methods for providing a docking device for watercrafts.

Implementation of the present invention takes place in association with an apparatus that is configured to receive a watercraft. In at least one implementation, an apparatus is built out of lightweight aluminum tubing for the convenience of docking a small watercraft on any type of shore while still protecting the keel and hull of the watercraft. The apparatus includes a fold down anchor on one end of the frame for the purpose of anchoring itself to the shore, using the weight of the watercraft. Extendable arms on each side of the frame, opposite the anchor, fold out to stabilize the apparatus on the shore. The apparatus further includes a receiving system that includes a plurality of rollers (e.g., four rollers or more rollers). Where four rollers are used, a first set of two rollers sit above the anchor to guide the watercraft onto the apparatus while gliding onto the shore. A second set of two rollers are located on the top of the mounting device to hold the hull in place while docked.

While the methods and processes of the present invention have proven to be particularly useful in the area of docking boats, those skilled in the art can appreciate that the methods and processes can be used in a variety of different applications and in association with a variety of watercrafts for the securing of the watercrafts. Examples of such watercrafts include fishing boats, motorboats, kayaks, canoes, jet skies, wave runners, and other watercrafts.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to watercrafts. In particular, the present invention relates to systems and methods for providing a docking device for watercrafts. In at least some embodiments, an apparatus is provided that is configured to receive a watercraft.

Embodiments of the present invention embrace the docking of a watercraft on any type of shoreline with little effort. Watercrafts, such as ski boats, fishing boats, pleasure boats, and speed boats are becoming more common on lakes and waterways. With the increase of watercrafts comes a decrease in the availability of docking facilities to secure boats during times of inactivity.

Embodiments of the present invention enable a watercraft to turn any shoreline into a secure and safe landing for the watercraft, while avoiding damage, such as to the keel and hull of the watercraft. Use eliminates the possibility of damage from rocks, sticks, debris, and sand to the keel and hull of the watercraft, therefore helping to keep the bottom of the watercraft in good condition and looking new.

Figure 1:
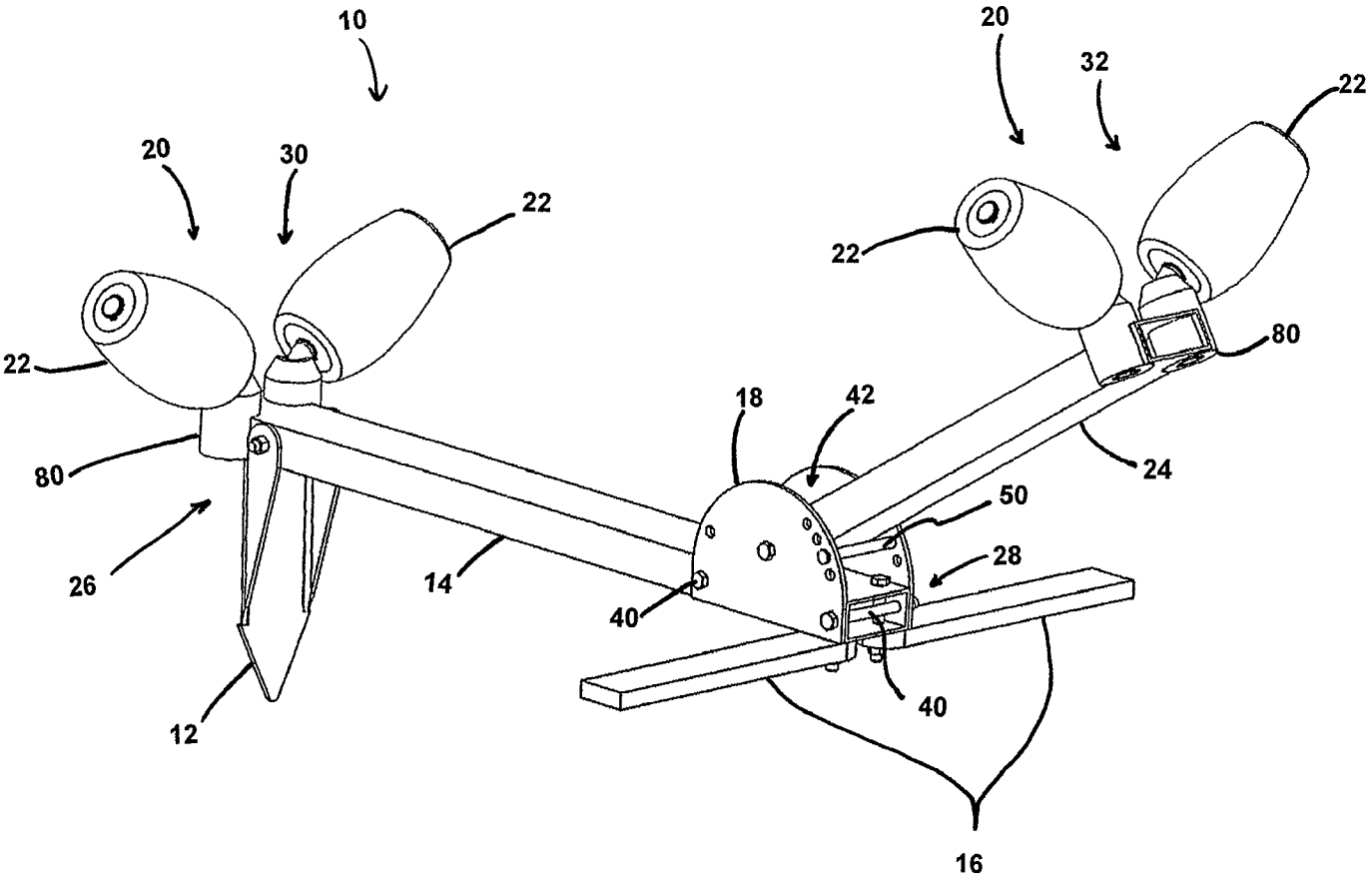
FIG. 1 illustrates a perspective view of a representative embodiment of the present invention.
Figure 2:
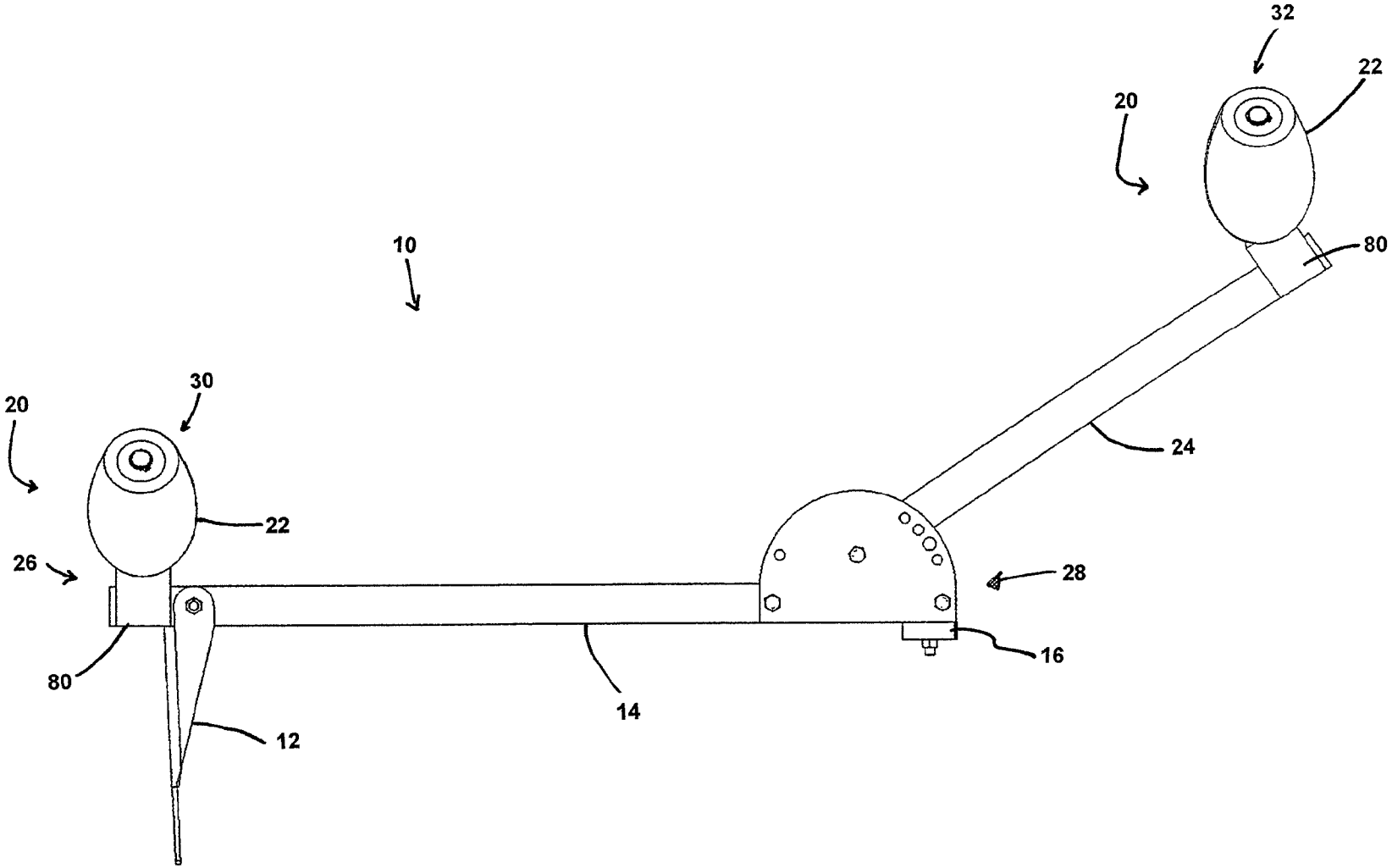
FIG. 2 illustrates a side view of a representative embodiment of the present invention.
Figure 3:
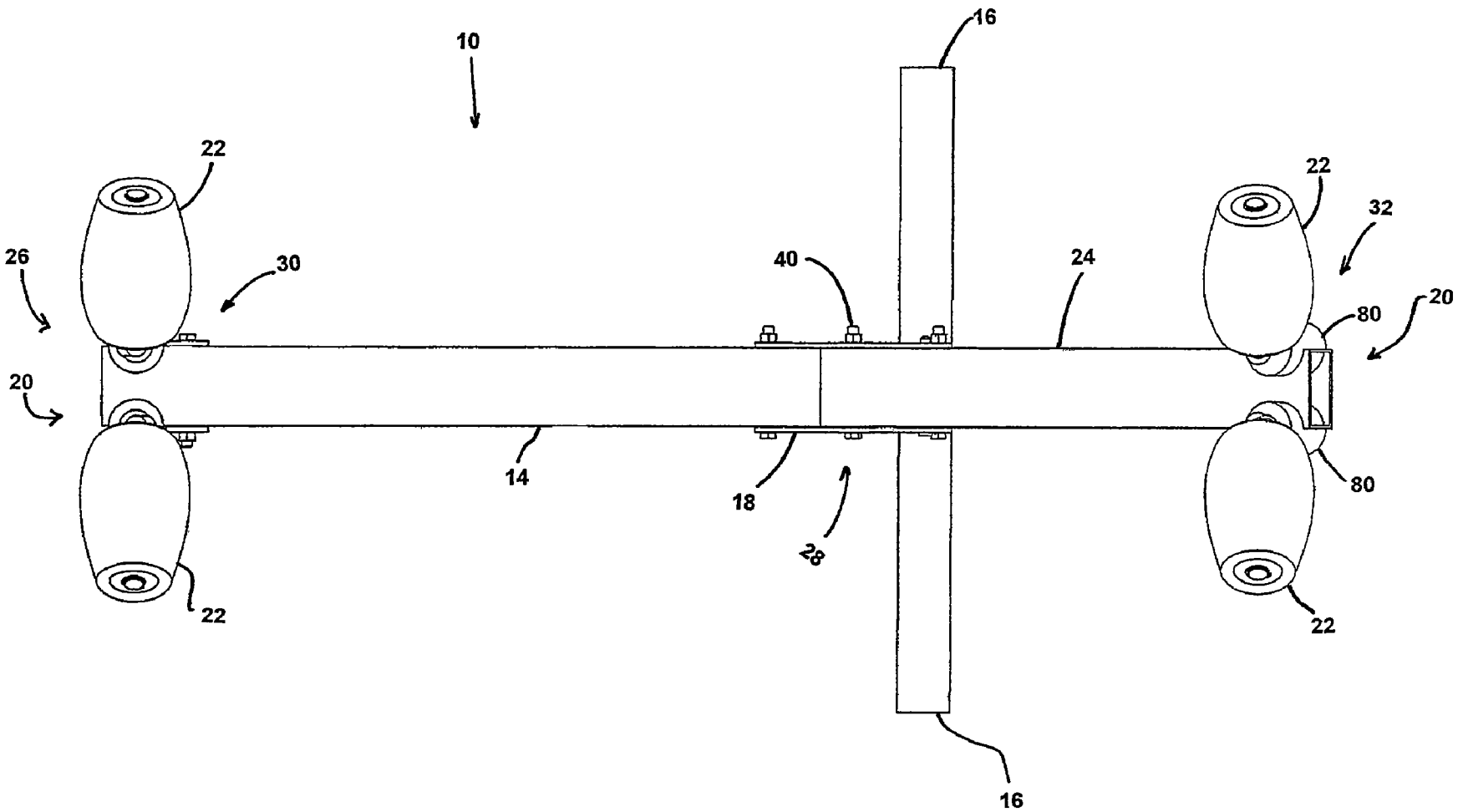
FIG. 3 illustrates a top view of a representative embodiment of the present invention.
Figure 4:
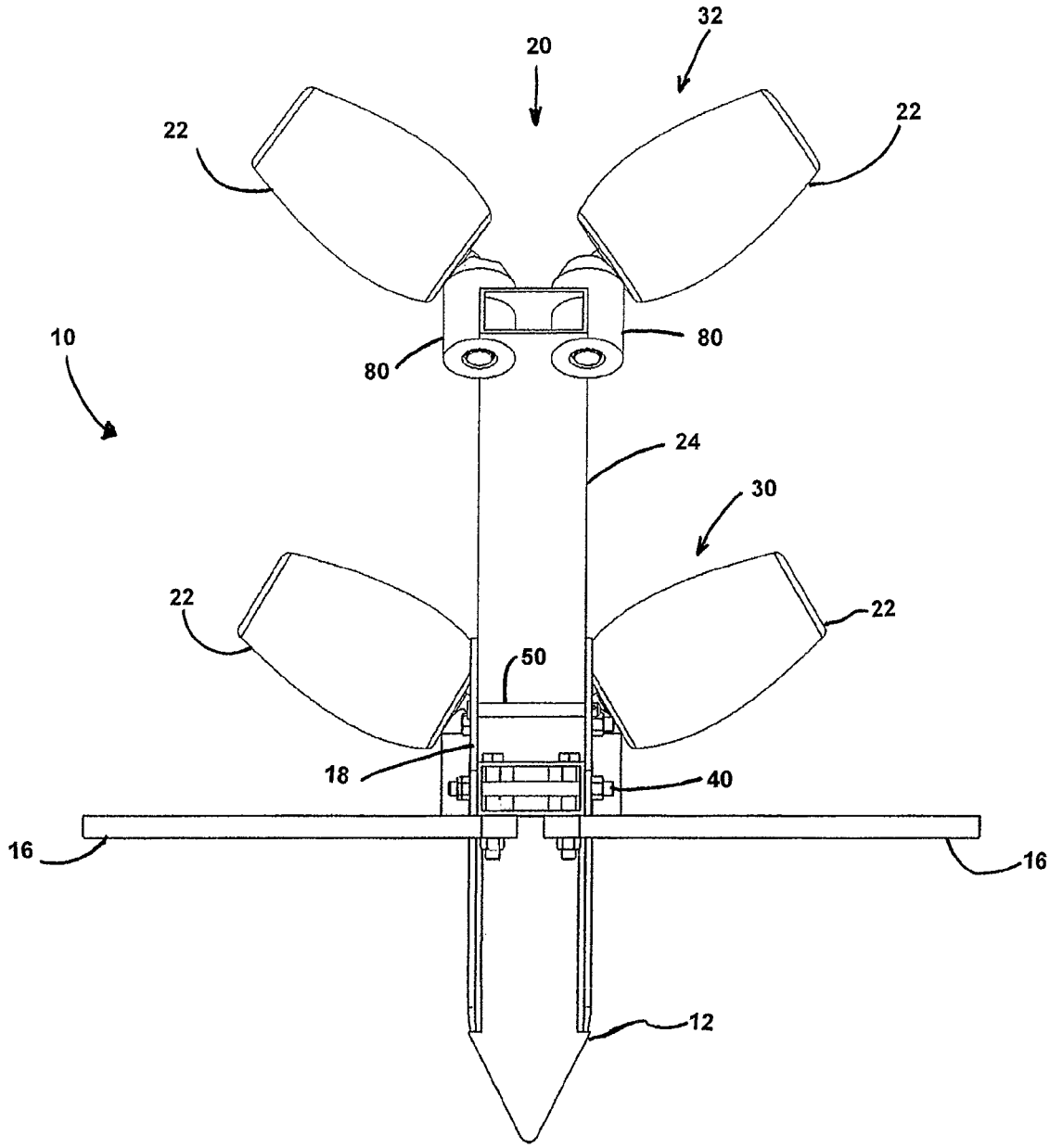
FIG. 4 illustrates an end view of a representative embodiment of the present invention.
Figure 5:
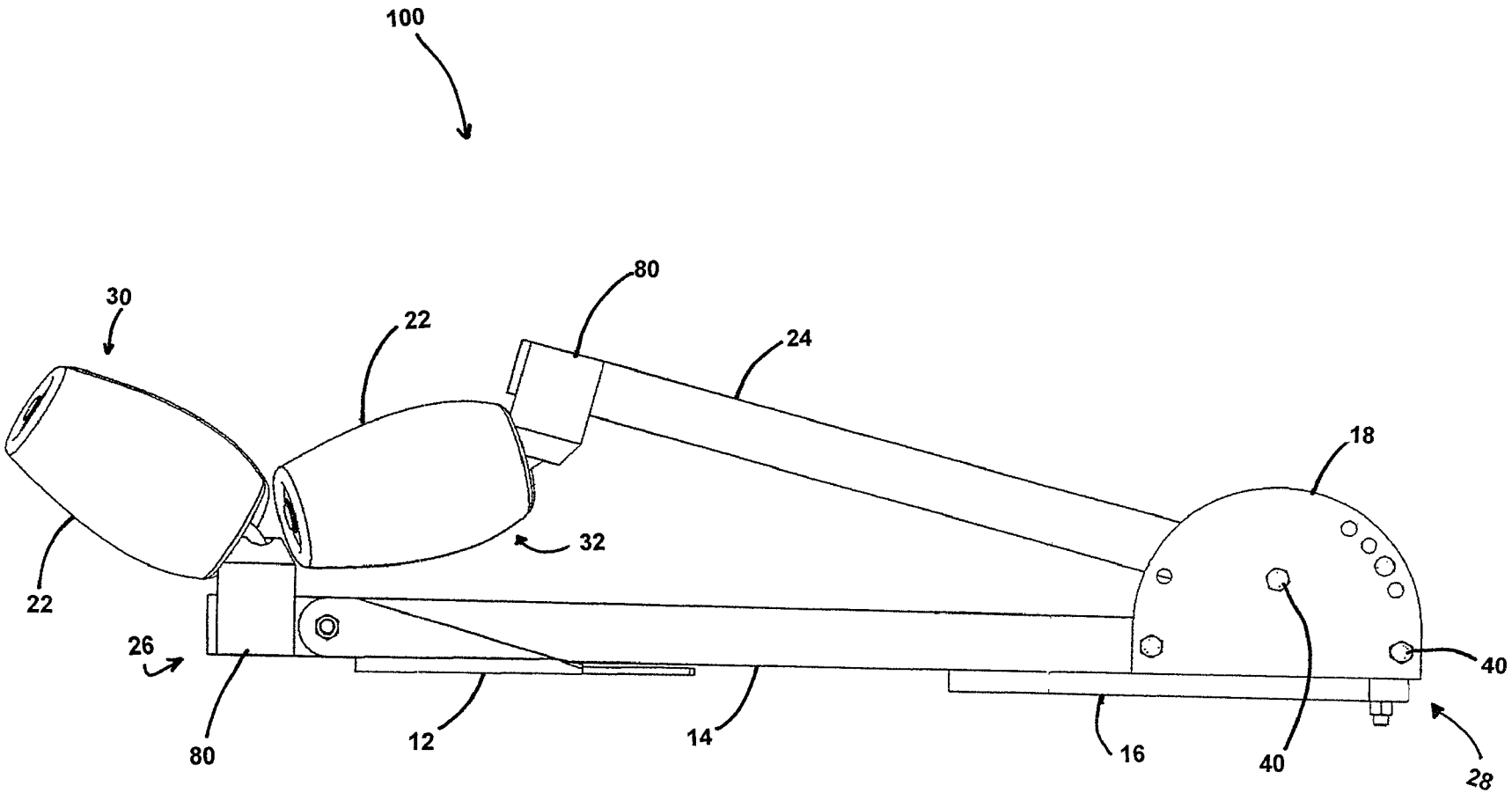
FIG. 5 illustrates a side view of a representative embodiment of the present invention, wherein the embodiment is in a folded position.
Figure 6:
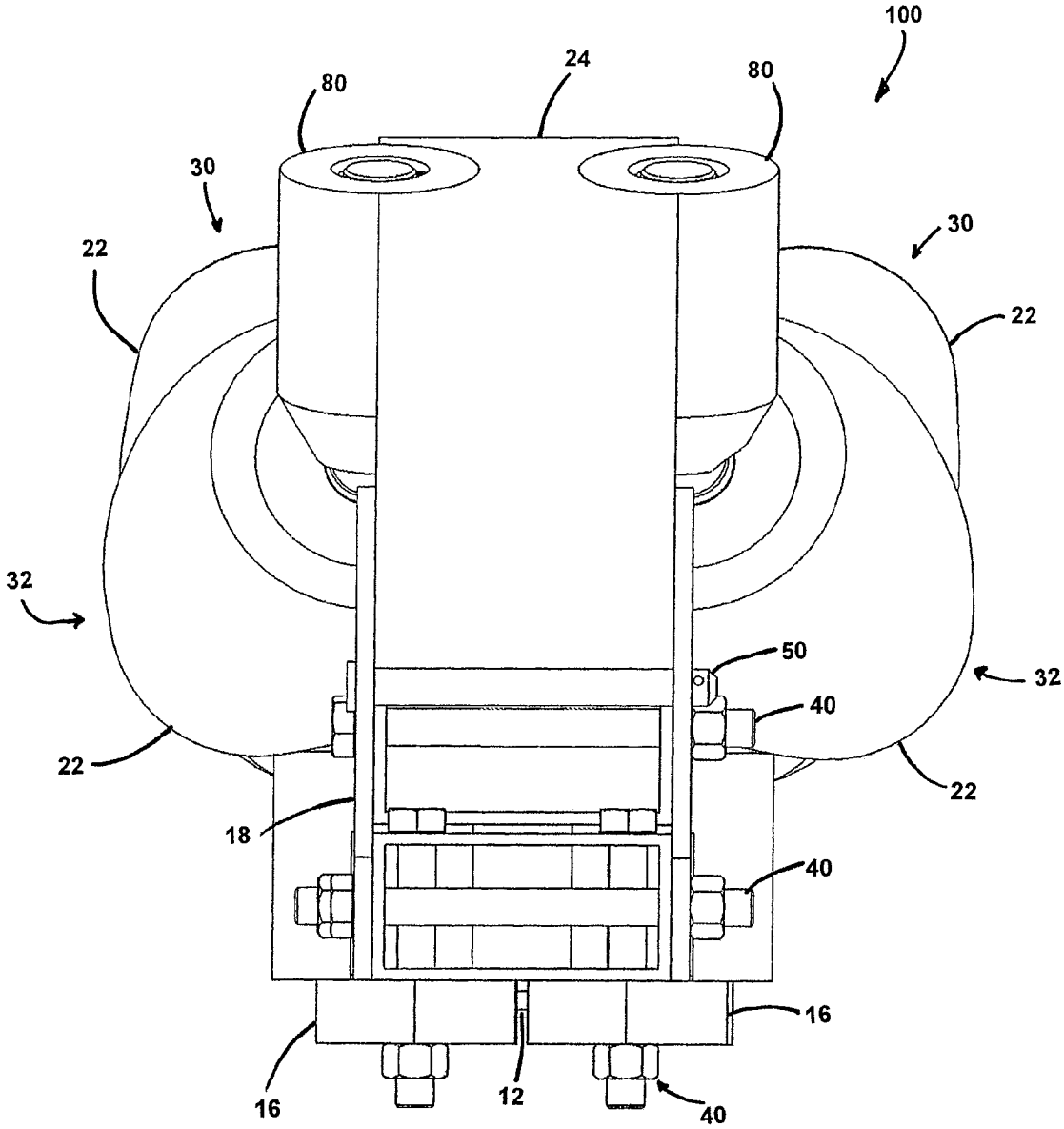
FIG. 6 illustrates another view of a representative embodiment of the present invention.
Figure 7:
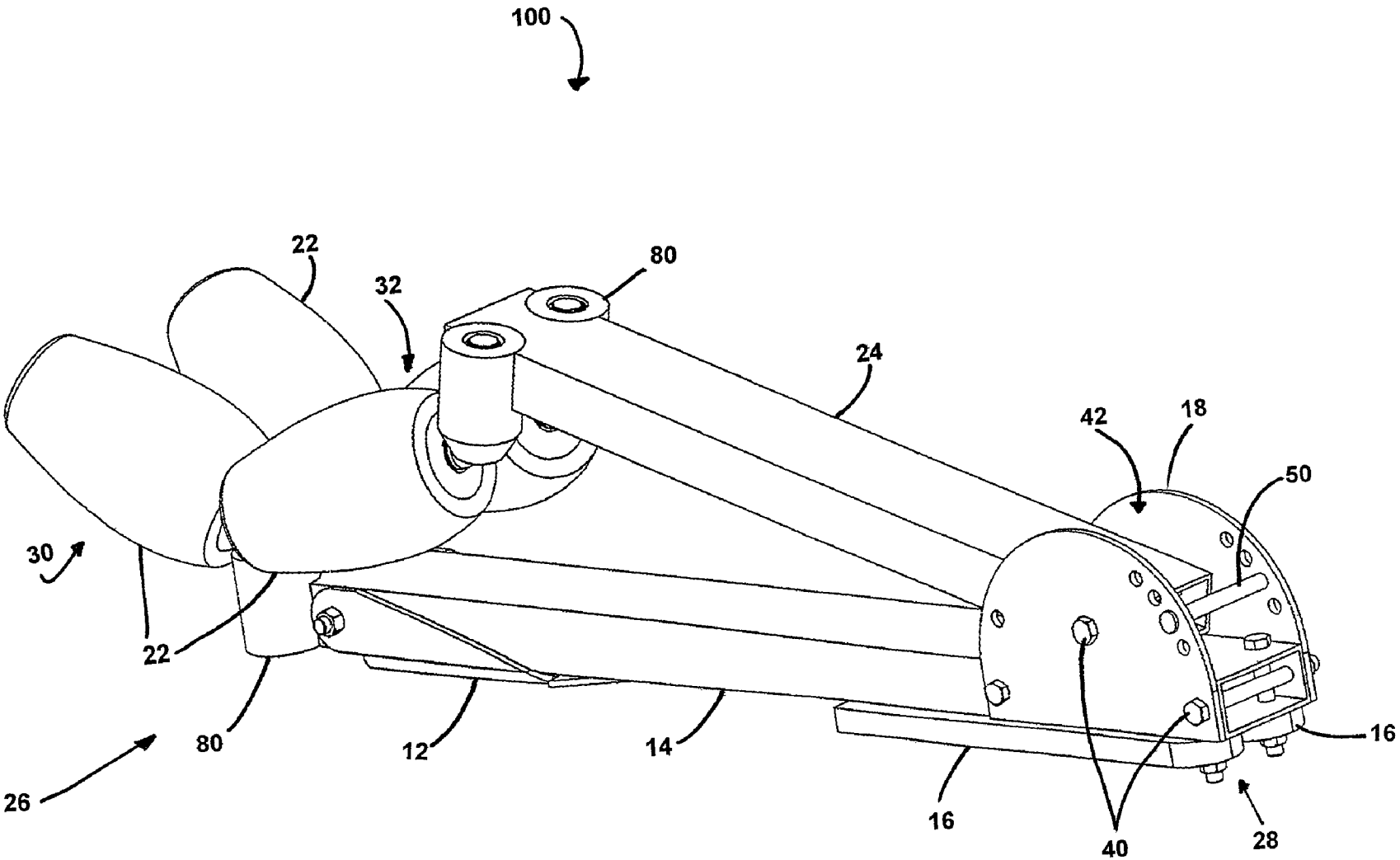
FIG. 7 illustrates a perspective side view of a representative embodiment of the present invention, wherein the embodiment is in a folded position.
Figure 8:
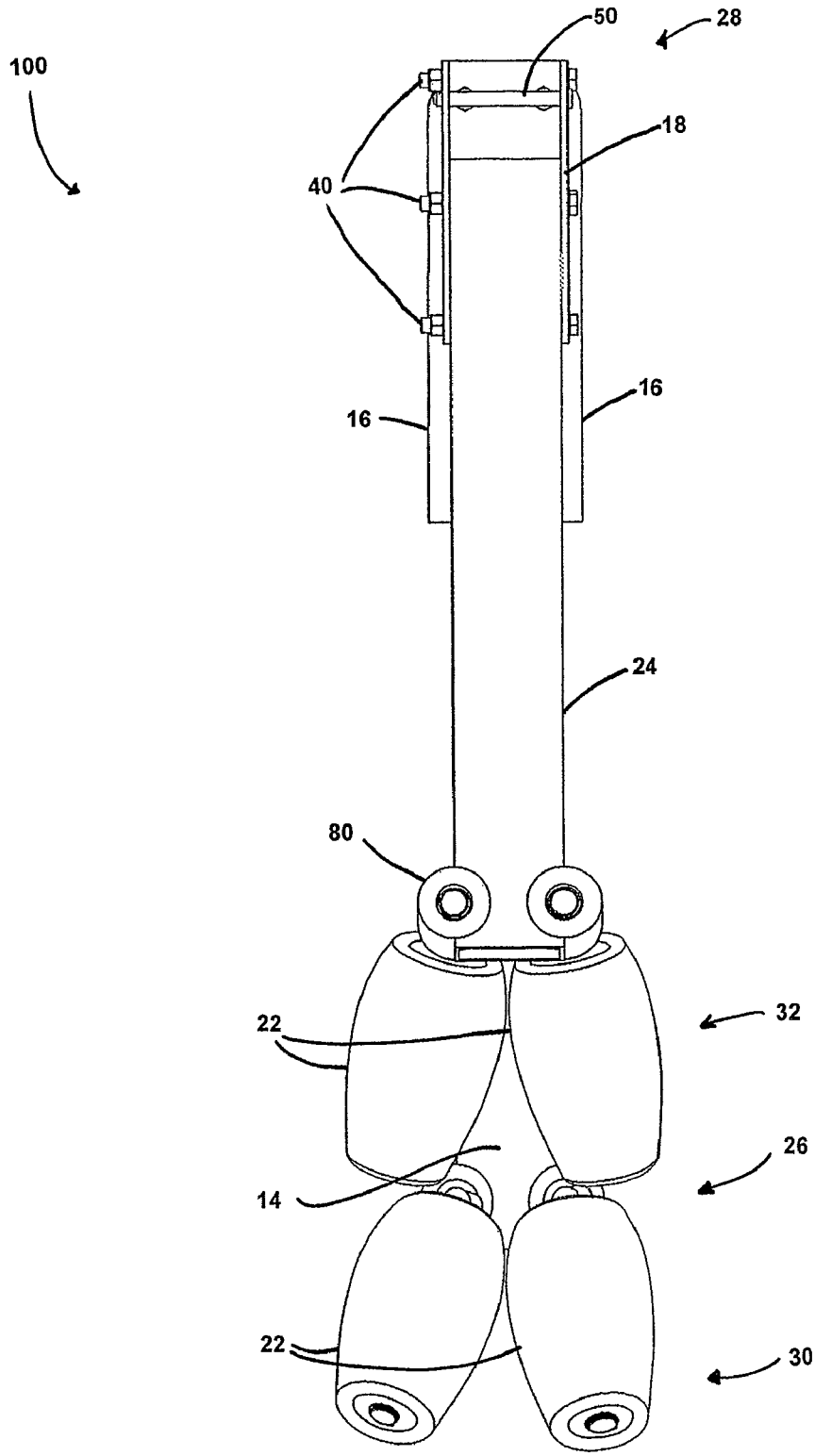
FIG. 8 illustrates a top view of a representative embodiment of the present invention, wherein the embodiment is in a folded position.

With reference now to FIGS. 1-4, a representative embodiment of the present invention is illustrated as a docking apparatus 10. In the illustrated embodiment, the apparatus 10 includes a fold down anchor 12 hingedly attached to a first end 26 of the frame 14. The anchor 12 is provided for the purpose of anchoring the apparatus 10 onto the shore, using the weight of the watercraft. In one embodiment, the anchor 12 is configured to fold into a position parallel with the frame 14. As such, the folded position of the anchor 12 minimizes the overall dimensions of the apparatus 10 (see FIGS. 5-8 below).

The frame 14 further comprises a bracket 18. The bracket is fixedly attached to a second end 28 of the frame 14. The bracket 18 may be attached to the frame by any available means. For example, in one embodiment the bracket 18 is attached to the frame 14 by welding or soldering. In another embodiment, the bracket 18 is reversibly attached to the frame 14 via fasteners, such as nuts and bolts 40. The bracket 18 provides a channel 42 for hingedly attaching a mounting device 24.

The mounting device 24 generally comprises a length of tubing positioned at an angle between 90° and 180° relative to the frame 14. The position and subsequent angle of the mounting device 24 is set by limiting the movement of the mounting device 24 within the bracket 18. The movement of the mounting device 24 may be limited inserting a bolt or pin 50 through a portion of the bracket 18, thereby providing a barrier to the forward motion of the mounting device 24. The bolt or pin 50 may include features to allow the user to easily remove and adjust the setting of the pin 50 without the need of tools. For example, in one embodiment the pin 50 includes a defeatable, outwardly biased ball that increases a portion of the pins diameter. As such, the ball of the pin 50 may be defeated by forcing the pin 50 through a hole in the bracket 18. Once inserted through the hole, the ball returns to an outwardly biased position securing the pin's position. Conversely, the pin 50 may be easily removed from the hole in the bracket 18 by reversing the process of insertion.

The second end 28 of the frame 14 further includes extendable arms 16. The extendable arms 16 are hingedly attached on each side of the frame 14. The extendable arms 16 are provided to stabilize the apparatus 10 on the shore. The extendable arms 16 may further include features to secure the apparatus 10 to varying terrain. For example, in one embodiment the arms 16 include a texture or gripping material on one or more surfaces. In another embodiment, the arms 16 include spikes or stakes to further anchor the device 10 into the terrain.

The apparatus further includes a receiving system 20. The receiving system 20 comprises a plurality of rollers 22. While the illustrated embodiment provides four rollers, other embodiments of the present invention embrace more than four rollers or less than four rollers. The rollers 22 include materials compatible with marine use. For example, in one embodiment the rollers 22 comprise a material that is resistant to salt water corrosion. In another embodiment, the rollers 22 comprise a material that is resistant to rust. In another embodiment, the rollers 22 comprise a polymer material that is non-abrasive. The rollers 22 are fixedly attached to the first end 26 of the frame 14, and the free end of the mounting device 24. In some implementations, additional rollers 22 are positioned along the frame 14 and the mounting device 24. The rollers 22 are generally attached to the apparatus 10 via a mounting hub 80, described in greater detail below.

The apparatus 10 may be configured to accept any number or combination of rollers 22. For example, where four rollers 22 are used, a first set 30 of two rollers 22 are pivotally attached to the frame 14, adjacent the anchor 12, in an outward orientation perpendicular to the frame 14. As such, the first set 30 of rollers 22 is provided to initially guide the watercraft onto the apparatus 10. A second set 32 of two rollers 22 are pivotally attached to the free end of the mounting device 24 in an outward orientation perpendicular to the mounting device 24. As such, the second set 32 of rollers 22 is provided to hold the hull of a boat within the apparatus 10. Additionally, the first and second sets 30 and 32 of rollers 22 may be outwardly angled to optimally accommodate the shape of the hull. Additionally, the shape of the roller 22 may be designed to universally accommodate a variety of hull shapes.

The rollers 22 of the apparatus 10 further permit the watercraft to move forward and backward, relative to the apparatus 10, in response to the oscillation of waves, the wind, and the tide. For example, where a watercraft is docked within the apparatus 10 and a tide causes the watercraft to move towards the shore, the rollers 22 allow the watercraft to surge forward with the tide without displacing the apparatus 10. Specifically, the contact surface 60 of the rollers 22 maintains contact with the hull of the watercraft as the watercraft moves towards the shore. As such, the underside of the watercraft is prevented from contacting the shore and sustaining damage.

In some implementations of the invention, the free end of the mounting device 24 may be modified to include a mechanism for maintaining contact with the hull of the watercraft. For example, in one embodiment the free end of the mounting device 24 is modified to include an air bladder such that the free end of the mounting device 24 pivots relative to the surface of the water. Therefore, if the level of the water increases thereby increasing the suspended level of the watercraft hull, the free end of the mounting device 24 adjusts accordingly such that the second set 32 of rollers 22 maintains contact with the watercraft hull. Additionally, the pivotally attached end of the mounting device 24 may be modified to include a spring device (not shown). In this embodiment, the mounting device 24 is biased to an angle of less than 90° such that the mounting device 24 is held to an angle of greater than 90° by the presence of the watercraft hull. Therefore, if the level of the water increases thereby increasing the suspended level of the watercraft hull, the free end of the mounting device 24 adjusts, or biases inwardly so as to maintain contact with the hull of the watercraft.

Referring now to FIGS. 5-8, a representative embodiment of the present invention is illustrated in a folded configuration. As illustrated, the folded apparatus 100 comprises the same elements and features of the unfolded apparatus 10 as illustrated in FIGS. 1-4. However, the configuration and overall dimensions of the folded apparatus 100 are different. For example, the anchor 12 has been folded to a position parallel to the frame 14. Likewise, the extendable arms 16 have been retracted to a position parallel to the frame 14. The second set 32 of rollers 22 has been pivoted to a position parallel to the mounting device 24, and the mounting device 24 has been retracted to a position less than 90° relative to the frame 14. Finally, the first set 30 of rollers 22 has been pivoted to a position parallel to the frame 14. Alternatively, the first and second sets 30 and 32 of rollers 22 are configured to pivot inwardly towards the frame 14 and the mounting device 24. As such, the overall width of the apparatus 10 is further reduced prior to storage and transportation. Furthermore, in one embodiment, the mounting device 24 is maintained in a folded or collapsed position by inserting the pin 50 into a portion of the bracket 18 thereby preventing the movement of the mounting device 24 to an extended position.

As configured, the folded apparatus 100 comprises dimensions that are more compact that the unfolded apparatus 10. As such, the folded apparatus 100 is more portable and storable. In one embodiment, a storage container (not shown) is provided for the folded apparatus 100. In this embodiment, the storage container includes a handle or strap to aid the user in carrying the container.

Figure 9:
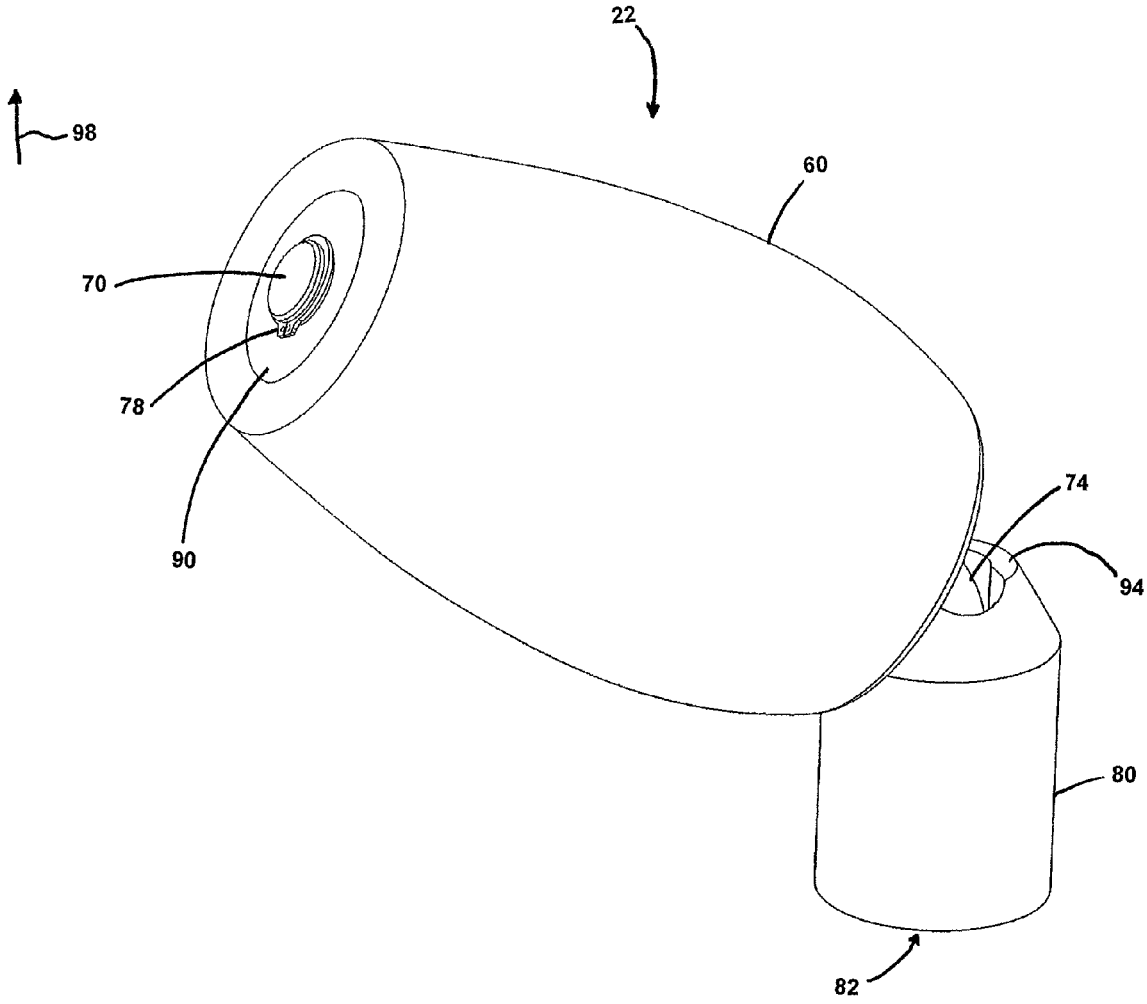
FIGS. 9-12 illustrate various views of representative rollers in accordance with embodiments of the present invention.
Figure 10:
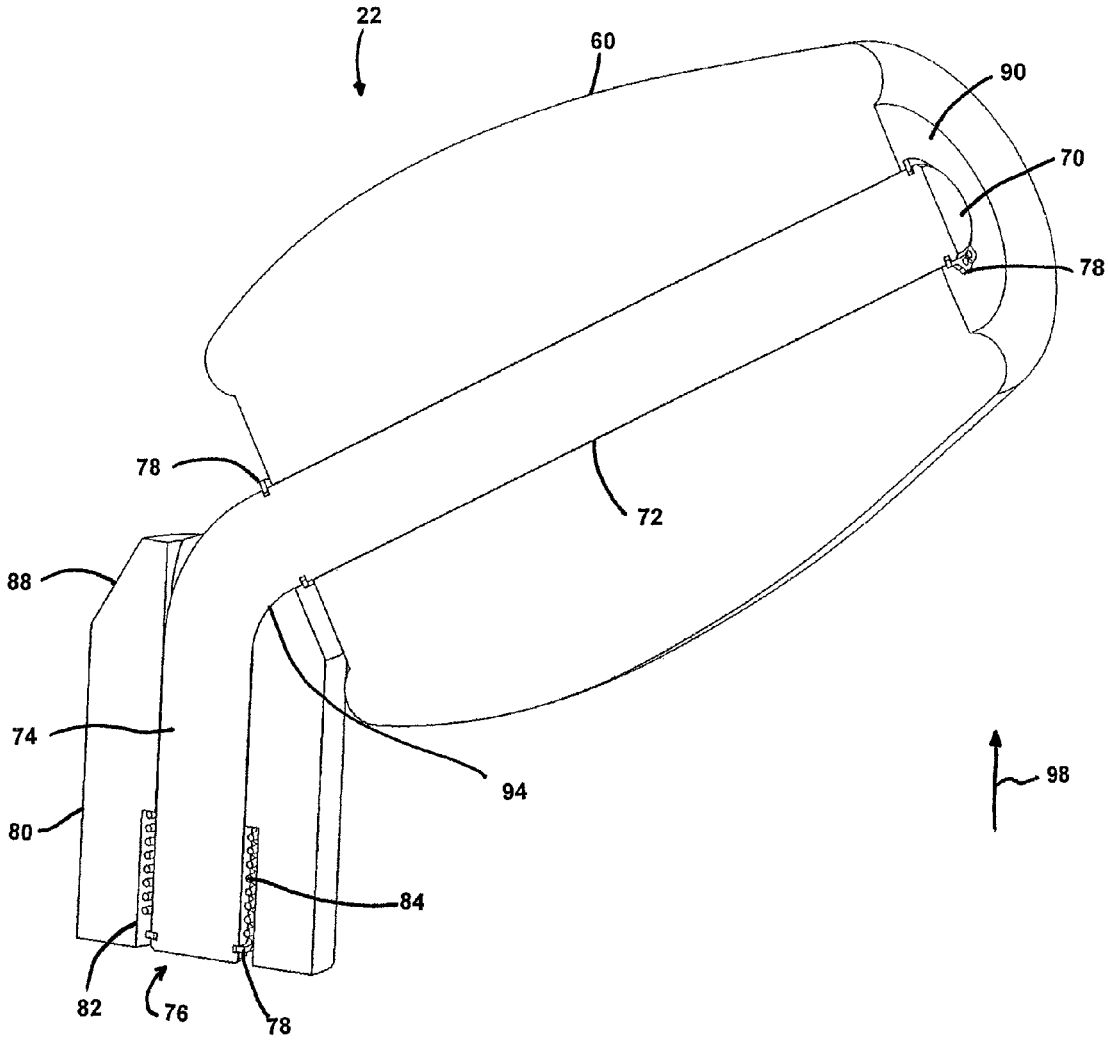
Figure 11:
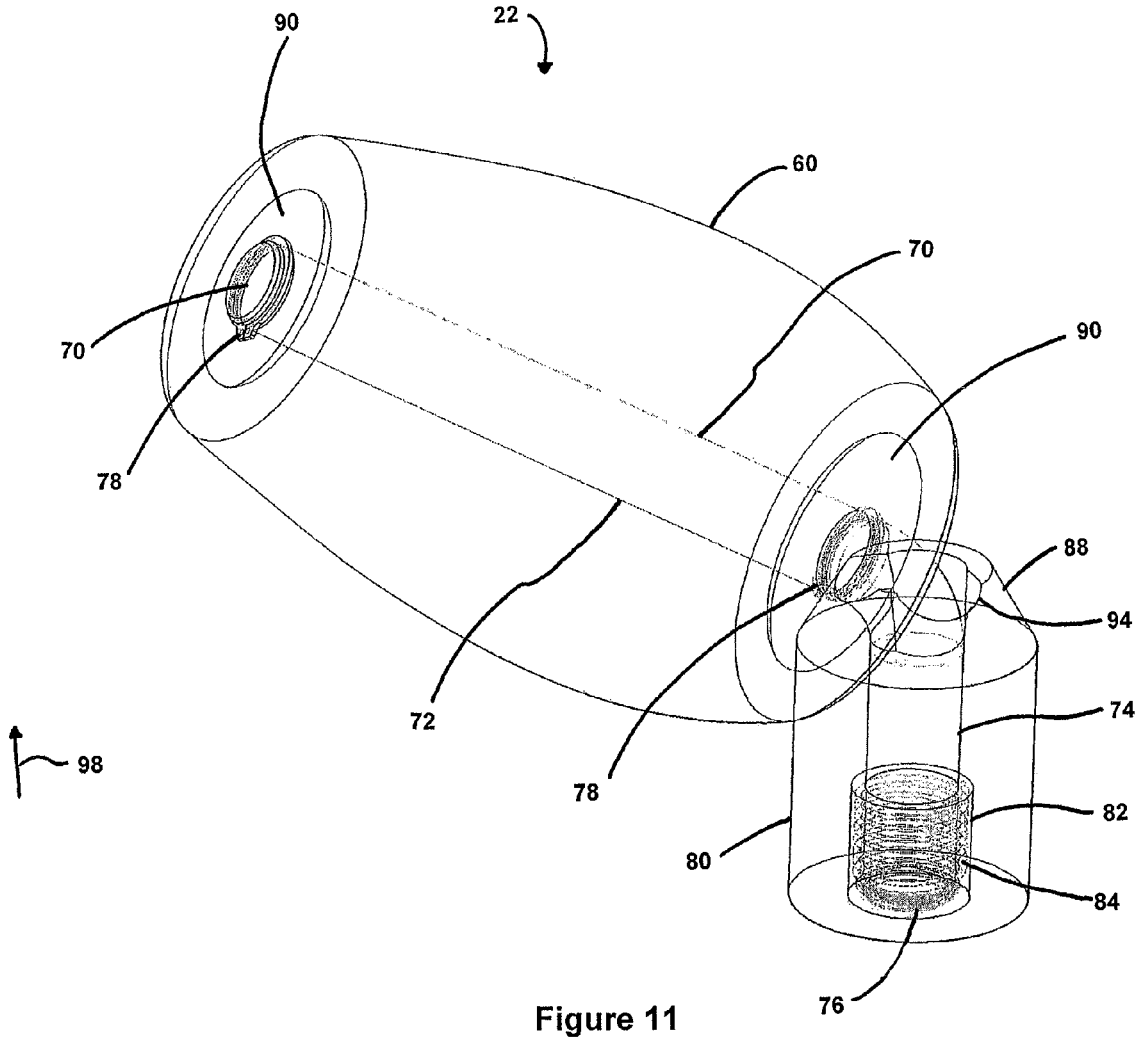
Figure 12:
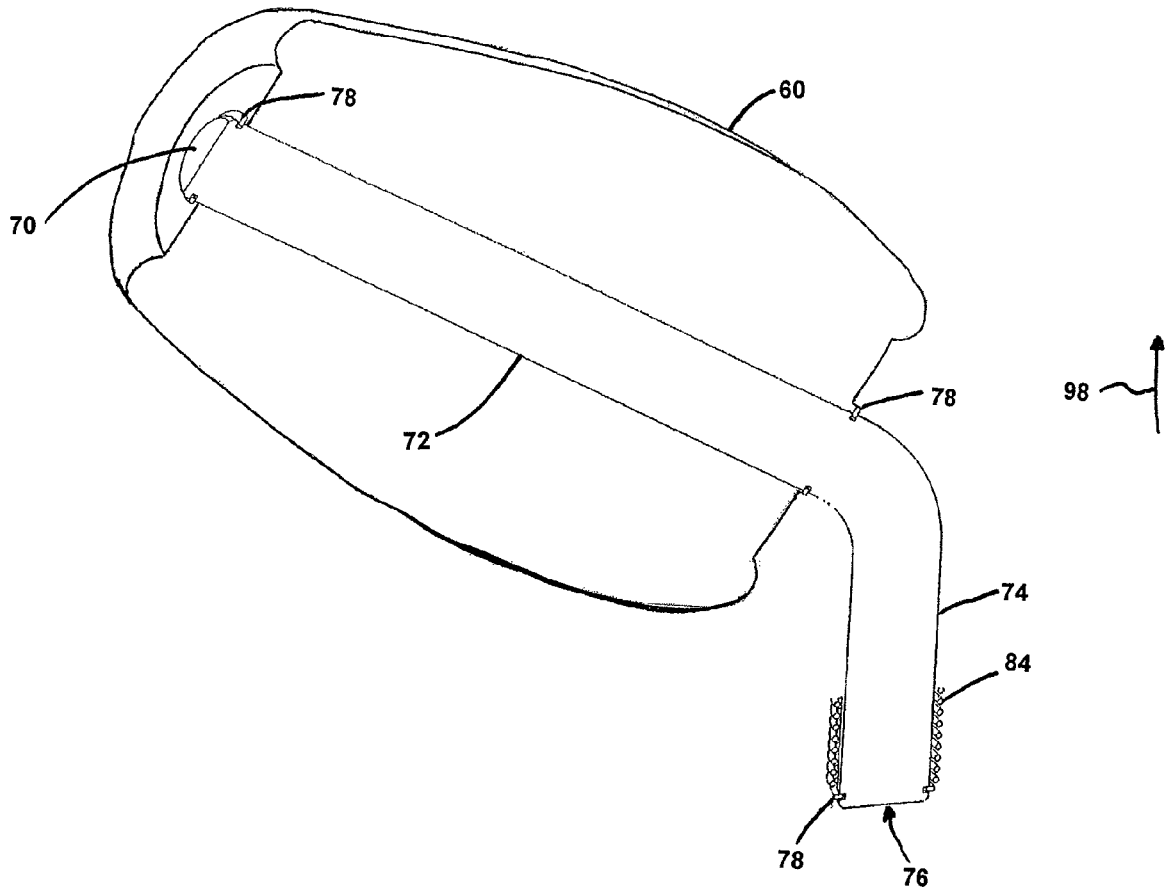

Referring now to FIGS. 9-12, various views of representative rollers are illustrated in accordance with embodiments of the present invention. The roller 22 comprises a contact surface 60, an axle 70, and a mounting hub 80. The contact surface 60 may comprise any shape or configuration compatible with use of the current invention. For example, in one embodiment, the contact surface 60 is a pear shape. In another embodiment, the contact surface is cylinder shape. The contact surface 60 of the roller 22 may also be solid or hollow, depending upon the need of the user. For example, where the boat of the user is especially heavy, the contact surface 60 is configured to be solid. Conversely, where the boat of the user is especially light, the contact surface 60 is configured to be hollow, thereby reducing the overall weight of the apparatus 10.

The material of the contact surface 60 may include any material generally compatible with marine use. For example, in one embodiment the contact surface 60 comprises a non-abrasive polymer material. The contact surface 60 may further include a texture or coating to increase the friction coefficient of the roller 22. Additionally, the roller 22 may include a color or pattern to increase the visibility of the roller 22 in murky or rough waters. For example, in one embodiment the roller is yellow with black stripes thereby increasing the visibility of the roller 22.

The contact surface 60 of the roller 22 is retained on an axle 70 by one or more spring clips 78 and retaining washers 90. The axle 70 generally comprises a solid rod; however hollow tubing may be used as needed. The axle 70 comprises a shaft region 72 and an anchoring region 74. The shaft region 72 is inserted through the contact surface 60 of the roller 22, thereby providing a structure around which the contact surface 60 of the roller 22 may rotate. The shaft region 72 of the axle 70 terminates where the axle 70 is bent to provide the anchoring region 74. The anchoring region 74 is the portion of the shaft 70 not parallel to the shaft region 72. The anchoring region 74 is mostly inserted into the mounting hub 80 such that the contact surface 60 is pivotally coupled to the mounting hub 80 via the axle 70.

The mounting hub 80 comprises a generally cylindrical sleeve having a hollow shaft with an inner diameter slightly greater than the outer diameter of the anchoring region 74 of the axle 70. Additionally, an upper region 88 of the outer surface of the mounting hub 80 is chamfered to provide clearance for the contact surface 60 of the roller 22. The upper region 88 further includes one or more positioning notches 94. The position notch 94 is provided to maintain the rotational position of the contact surface 60 relative to the mounting hub 80. Additionally, a portion of the anchoring region 74 may include a pin (not shown) for compatibly engaging one or more of the positioning notches 94. In one embodiment, the pin (not shown) extends perpendicularly from one or more sides of the anchoring region 74 such that the width of the pin is greater than the diameter of the anchoring region 74. As such, the pin compatibly engages one or more of the positioning notches 94 thereby retaining the roller in a desired position.

The mounting hub 80 further includes an inner chamber 82 for retaining the anchoring region 74 of the shaft 70. The inner chamber 82 comprises an inner diameter sufficient to house the anchoring region 74 a spring 84. The spring 84 is positioned within the inner chamber 82 so as to fit over the anchoring region 74 of the axle 70. Furthermore, the spring 84 is coupled to the axle 70 at the terminal end 76 of the anchoring region 74. As such, the axle 70 is prevented from being removed from the mounting hub 80. Specifically, as the axle 70 is moved in an upward direction 98, the spring 84 is compressed and retained within the inner chamber 82. Thus, the spring 84 prevents the anchoring region 74 of the axle 70 from being removed. However, the axle 70 can be moved within the mounting hub 80 in an upward direction 98 and subsequently pivoted to a desired orientation.

In some embodiments, the apparatus comprises lightweight aluminum for the convenience of docking a small watercraft on any type of shore while still protecting the keel and hull of the watercraft. In some embodiments, the device is portable. However, those skilled in the art will appreciate that embodiments of the present invention embrace other materials, including other metals, alloys, rubbers, and polymer materials.

The apparatus 10 may be used in conjunction with other devices to further secure the watercraft to the shore. For example, in one embodiment a mooring device comprising at least one rope is used to secure the watercraft to rocks, tree stumps, down trees or even portable stakes on the shore. Additionally, in another embodiment a mooring device having two ropes is attached to the rear corners of the watercraft so as to secure, stabilize, and prevent the watercraft from moving around from wind or waves coming on shore. This method of mooring further allows the watercraft to remain secured for long stays on shore or overnight docking.

In at least some embodiments of the present invention, the apparatus permits the watercraft to move on the rollers as waves from the water pass by. Accordingly, in at least some embodiments, as a wave approaches and passes the watercraft, the watercraft is allowed to move vertically due to the wave but maintains contact to rollers of the apparatus. In a further embodiment, one or more anchor lines are coupled to the watercraft and to the shore or to a support.

At least some embodiments of the present invention are portable. The lightweight design and convenient fold-up ability of at least some embodiments allows for easy storage on the watercraft. The lightweight design of the apparatus also allows it to be set up in minutes, allowing families to enjoy the shoreline as a docking facility while having barbeques, hiking, or any other shore activity.

In at least some embodiments, a coupling mechanism is used to couple a roller to a frame member. Those skilled in the art will appreciate that embodiments of the present invention embrace a variety of different coupling mechanisms. In some embodiments, the coupling mechanism includes a pin, rod or shaft. In some embodiments, the pin is a del pin. In at least some embodiments, at least a portion of the coupling mechanism is used to lock a particular member in place.

Thus, as discussed herein, the embodiments of the present invention embrace devices for watercrafts. In particular, the present invention relates to systems and methods for providing a portable docking device for watercrafts.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A docking apparatus, comprising:

an elongated frame having a first portion and a second portion;

an elongated mounting device having an attached portion and a free portion, wherein the attached portion of the mounting device is hingedly attached to the second portion of the frame about an axis that runs transverse to both a longitudinal axis of the frame and a longitudinal axis of the mounting device so as to allow the mounting device to selectively pivot to any of a plurality of angles between about 90 degrees and about 180 degrees with respect to the frame;

a first boat receiving system that is coupled to the first portion of the frame and is sized and shaped to receive a portion of a watercraft; and a second boat receiving system comprising a plurality of boat contact surfaces, wherein the second boat receiving system is coupled to the free portion of the mounting device and is sized and shaped to receive the portion of the watercraft.

2. The docking apparatus of claim 1, wherein the first boat receiving system comprises a first set of rollers, and wherein the second boat receiving system comprises a second set of rollers.

3. The docking apparatus of claim 1, further comprising a plurality of stabilizing arms that are pivotally attached to the second portion of the frame.

4. The docking apparatus of claim 2, wherein the first and second sets of rollers comprise a plurality of rollers.

5. The docking apparatus of claim 1, the apparatus further comprising a bracket, the bracket being fixedly attached to the frame, and the mounting device being pivotally attached to the bracket.

6. The docking apparatus of claim 5, wherein the bracket includes one or more adjustment positions to receive a retaining pin, whereby the placement of the retaining pin limits the movement of the mounting device relative to the frame.

7. The docking apparatus of claim 2, wherein the mounting device, the first set of rollers, and the second set of rollers further comprise an open position and a closed position, the open position being configured to dock the watercraft, and the closed position configured to reduce the size of the docking apparatus relative to the open position.

8. A device for temporarily mooring a watercraft, the device comprising:

an elongated frame having a first portion and a second portion;

an elongated mounting device having an attached portion and a free portion, wherein the attached portion of the mounting device is hingedly attached to the second portion of the frame about an axis that runs transverse to a longitudinal axis of the frame and a longitudinal axis of the mounting device in a manner that allows the longitudinal axis of the frame to pivot towards and extend away from the longitudinal axis of the mounting device so that the mounting device is able to selectively pivot to an angle of less than 90 degrees with respect to the frame as well as to an angle that is greater than 90 degrees with respect to the frame;

stabilizing means pivotally attached to the second portion of the frame;

an anchor pivotally attached to the first portion of the frame;

a first set of rollers coupled to the free portion of the mounting device; and a second set of rollers coupled to the first portion of the frame.

9. The device of claim 8, wherein the first set of rollers is pivotally attached to the free portion of the mounting device, and the second set of rollers is pivotally attached to the second portion of the frame.

10. The device of claim 8, wherein the first and second set of rollers comprise a plurality of rollers.

11. The device of claim 8, the device further comprising a bracket, the bracket being fixedly attached to the frame, and the attached portion of the mounting device being pivotally attached to the bracket.

12. The device of claim 11, wherein the bracket includes a plurality of adjustment positions to receive a retaining pin, whereby the placement of the retaining pin in one of the plurality of adjustment positions limits the movement of the mounting device relative to the frame.

13. The device of claim 8, wherein the mounting device, the stabilizing means, the anchor, the first set of rollers, and the second set of rollers further comprise an open position and a closed position, the open position being configured to moor the watercraft, and the closed position configured to reduce the size of the mooring device relative to the open position.

14. A method for temporarily mooring a watercraft, the method comprising:

providing a mooring device, the mooring device comprising:

an elongated frame having a first portion and a second portion;

an elongated mounting device having an attached portion and a free portion, wherein the attached portion of the mounting device is hingedly attached to the second portion of the frame about an axis that runs transverse to both a longitudinal axis of the frame and a longitudinal axis of the mounting device so that the mounting device is able to selectively pivot to an angle of less than 90 degrees with respect to the frame as well as to an angle that is greater than 90 degrees with respect to the frame;

stabilizing means pivotally attached to the second portion of the frame;

an anchor pivotally attached to the first portion of the frame;

a first set of rollers coupled to the free portion of the mounting device; and a second set of rollers coupled to the first portion of the frame;

positioning the mooring device adjacent to a waterline of a desired mooring location;

aligning the watercraft with the mooring device such that a portion of the watercraft contacts the first and second set of rollers of the mooring device; and securing the watercraft to terrain adjacent to the desired mooring location via a line.

15. The method of claim 14, wherein the first set of rollers is pivotally attached to the free portion of the mounting device, and the second set of rollers is pivotally attached to the second portion of the frame.

16. The method of claim 14, wherein the first and second sets of rollers comprise a plurality of rollers.

17. The method of claim 14, the mooring device further comprising a bracket, the bracket being fixedly attached to the frame, and the attached portion of the mounting device being hingedly attached to the bracket.

18. The method of claim 17, wherein the bracket includes a plurality of adjustment positions to receive a retaining pin, whereby the placement of the retaining pin in one of the plurality of adjustment positions limits the movement of the mounting device relative to the frame.

19. The method of claim 14, wherein the mounting device, the stabilizing means, the anchor, the first set of rollers, and the second set of rollers further comprise an open position and a closed position, the open position being configured to moor the watercraft, and the closed position configured to reduce the size of the mooring device relative to the open position.

20. The method of claim 19, wherein following the use of the mooring device, the mooring device is returned to the closed position.

* * * * *